US005820763A

United States Patent [19]

Fujita et al.

[11] Patent Number: 5,820,763

[45] Date of Patent: Oct. 13, 1998

[54] METHOD FOR INHIBITING CORROSION IN WATER SYSTEMS

[75] Inventors: Kazuhisa Fujita; Hiroshi Kurobe; Kuniyuki Takahashi, all of Tokyo, Japan

[73] Assignee: Kurita Water Industries, Ltd., Japan

[21] Appl. No.: 822,192

[22] Filed: Mar. 20, 1997

[51] Int. Cl.[6] ..... B01D 15/00

[52] U.S. Cl. ..... 210/663; 210/683; 210/698; 210/754; 210/756; 210/764; 422/17; 422/18

[58] Field of Search ..... 210/663, 668, 210/683, 754, 756, 764, 698, 701; 411/17, 18

[56] References Cited

U.S. PATENT DOCUMENTS

| | | | |
|---|---|---|---|
| 3,463,730 | 8/1969 | Booth et al. | 210/701 |
| 3,879,288 | 4/1975 | Siegele | 210/701 |
| 4,483,772 | 11/1984 | Rolke et al. | 210/683 |
| 4,663,053 | 5/1987 | Geiger | 210/699 |
| 4,929,424 | 5/1990 | Meier et al. | 422/9 |
| 4,966,775 | 10/1990 | Donofrio et al. | 210/764 |
| 4,997,574 | 3/1991 | Sarunac | 210/754 |
| 5,128,045 | 7/1992 | Parsons et al. | 210/701 |

FOREIGN PATENT DOCUMENTS

| | | | |
|---|---|---|---|
| 6158364 | 6/1994 | Japan . | |
| 27316848 | 12/1995 | Japan | C23F 11/173 |
| 27334883 | 12/1995 | Japan . | |
| 47316852 | 12/1995 | Japan . | |

*Primary Examiner*—Jay H. Woo
*Assistant Examiner*—Betsey J. Morrison
*Attorney, Agent, or Firm*—Morrison Law Firm

[57] ABSTRACT

The water of a water system is treated to inhibit corrosion of metal components by passage through an anion exchanger preloaded with corrosion-inhibiting anions. A low molecular weight polymer is added. A chlorine containing slime controlling agent is added. The concentration of the chloride ion in water is maintained below 50 mg/L.

17 Claims, 1 Drawing Sheet

METHOD FOR INHIBITING CORROSION IN WATER SYSTEMS

BACKGROUND OF THE INVENTION

The present invention relates to a method for inhibiting corrosion of metal components in water systems. More particularly, the present invention relates to a method for inhibiting corrosion of mild steel, stainless steel, copper, copper alloy, and the like used in fresh water system components by treating makeup water with an anion exchanger and a slime-control agent.

Mild steel, stainless steel, copper, copper alloy and other metals are used for pipes and assorted components in fresh water systems, such as, for example, open or closed recirculating cooling water systems, heat accumulating water systems, and closed cooling and warming water systems. These metal components are immersed in fresh water, and therefore are subject to corrosion by corrosive ions brought in by makeup water, such as chloride ion ($Cl^-$) and sulfate ion ($So_4^{2-}$). Additionally, pitting corrosion can occur in these fresh water systems.

A variety of corrosion-inhibiting methods have been utilized to limit metal corrosion in components of fresh water systems. Japanese Laid-open Patent Publication No. 6-158364 (hereinafter "JP 6-158364") discloses a method wherein corrosive ion-containing water for a fresh water system is passed through an anion exchanger preloaded with such corrosion-inhibiting anions as $OH^-$ or $HCO_3^-$. The corrosive anions in makeup water such as $Cl^-$ and $SO_4^{2-}$ are exchanged with the corrosion-inhibiting anions in the anion exchanger, thereby the corrosive anion content is decreased. JP 6-158364 also discloses the use of other corrosion-inhibiting constituents, such as $Ca^{2+}$ and $SiO_2$, which are usually contained in the fresh water system. Finally, JP 6-158364 proposes adding a low molecular weight polymer to the water. By adding a low molecular weight polymer, a uniform corrosion-inhibiting film is formed on the surfaces of the metal components, inhibiting thus corrosion more firmly.

Considerable amounts of slime often form on metal components of commercial cooling water systems. This phenomenon is termed "biofouling". In a large cooling water system, such as those used at industrial complexes, excessive slime formation can create dangerous or expensive problems, such as flow blockage and sticking valves. A greater danger, however, is represented by corrosion under the slime layer. In this situation, the addition of slime-controlling agents becomes an absolute necessity.

While the anion exchange treatment method disclosed in Japanese Laid-open Patent Publication No. 6-158364 can inhibit corrosion in fresh water systems, biofouling can still occur. Therefore, slime-controlling agents must be used concurrently with corrosion-inhibiting procedures.

Conventionally, chlorine-containing compounds are employed as slime-controlling agents. Many kinds of chlorine-containing compounds have been used as slime controlling agents. Of these chlorine containing compounds, one group is characterized by an ability of generating hypochlorous acid (HclO) and/or hypochlorite ion ($Ocl^-$) in water and is thus oxidative. Chlorine, hypochlorites, chlorinated isocyanurates, bleaching powder and the like belong to this group, and are called hereafter chlorine containing oxidative slime controlling agents.

Another group of the chlorine containing compounds is characterized by an inability of generating hypochlorous acid or hypochlorite in water and is hence non-oxidative.

5-chloro-2-methyl-4-isothiazolin-3-on, 4,5-dichloro-1,2-dithiol and the like belong to this group and are called hereafter chlorine containing non-oxidative slime controlling agents.

An oxidative slime controlling agent is generally more corrosive than a non-oxidative one. Chlorine containing slime controlling agents, both oxidative and non-oxidative, release chloride ion in water by their decomposition. Use of a chlorine-containing slime-controlling agent thus increases the concentration of chloride ions, particularly corrosive, in the water. Corrosion of metal components can therefore be accelerated, rather than inhibited, when a chlorine-containing slime-controlling agent is used. When corrosive ion-containing water is treated by anion exchange, as in the method of JP 6-158364, the simultaneous use of a chlorine-based slime-controlling agent with the corrosion-inhibiting procedure is a concern, because this may play in decreasing the effectiveness of the anion exchange corrosion-inhibiting method.

OBJECTS AND SUMMARY OF THE INVENTION

Accordingly, it is an object of the present invention to provide a method to overcome the limitations of the prior art.

It is a further object of the present invention to provide a method to inhibit corrosion of a water system, by exchanging corrosive anions with corrosion-inhibiting anions, and by adding a low molecular weight polymer to the water of the water system.

It is a further object of the present invention to provide a method that allows effective use of a chlorine-containing slime-controlling agent without loss of the corrosion-inhibiting effect of anion exchanged water.

According to the method of the present invention, briefly stated, the makeup water of a water system is treated to inhibit corrosion of metal components by passage through an anion exchanger preloaded with corrosion-inhibiting anions. A low molecular weight polymer is added. The low molecular weight polymer forms a protective film on the surfaces of the metal components. A chlorine-containing slime controlling agent is added. The concentration of the chloride ion in the system water is maintained below 50 mg/L.

According to an embodiment of the invention, there is provided a metal corrosion inhibiting method for a water system, comprising the steps of passing water through an anion exchanger; the anion exchanger containing corrosion-inhibiting anions; adding a low molecular weight polymer to the water; adding a chlorine-containing slime controlling agent; and maintaining a chloride ion concentration in the water at a concentration below 50 mg/L.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
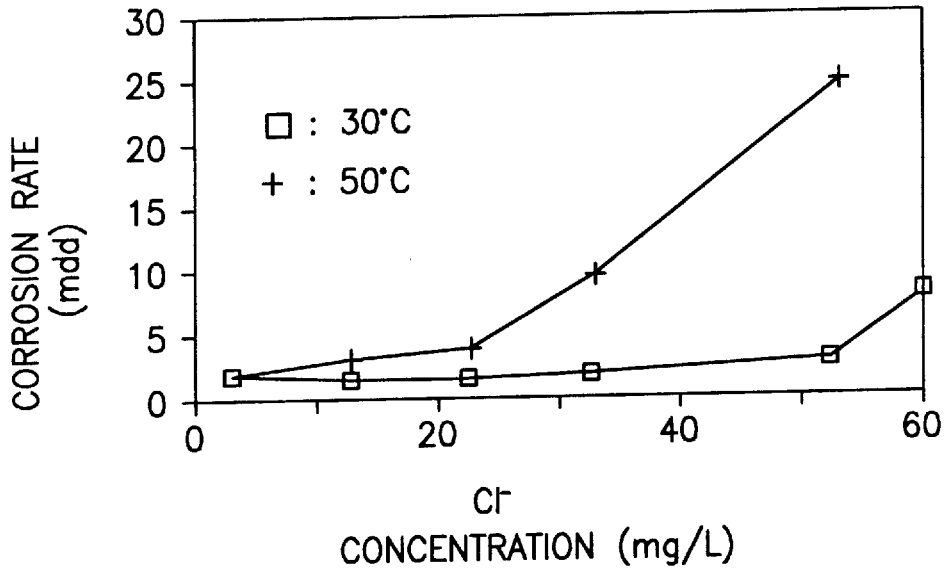
FIG. 1 is a graph showing the relationship between the concentration of $Cl^-$ and the corrosion rate, as determined in Experiment 1.

The present invention provides a metal corrosion-inhibiting method for a water system, wherein the chloride ion concentration is maintained below 50 mg/L. A water system having makeup water containing corrosive ions is brought into contact with an anion exchanger. The anion exchanger contains corrosion-inhibiting anions, which exchange with the corrosive anions. A low molecular weight polymer is added to the water system. A corrosion inhibiting film is formed on the metal surface due to the low molecular weight polymer, which further inhibits corrosion. Finally, a slime-controlling agent is added to inhibit biofouling. The concentration of chloride ion is maintained below 50 mg/L, and preferably below 30 mg/L.

The anion exchanger may be of any suitable type, such as, for example, an anion exchange resin. Corrosive anions such as $Cl^-$, $SO_4^{2-}$ and the like are exchanged with corrosion-inhibiting anions such as $OH^-$, $HCO_3^-$, and the like in the anion exchanger. The reduction in $Cl^-$ concentration inhibits pitting corrosion of mild steel, stainless steel, copper, brass. The reduction in $Cl^-$ concentration is also an effective preventive measure for the stress corrosion cracking often seen in stainless steel and brass. The reduction in $SO_4^{2-}$ prevents the formation of basic copper sulfate, which is the principal cause of pitting corrosion in copper and brass.

The corrosive ion-containing water of the water system may be brought into contact with the anion exchanger by any suitable method. For example, a packed column may be filled with an $HCO_3^-$-type anion exchange resin. Makeup water or circulating water, or both, are then passed through this packed column. The flow requirement and other ion exchange conditions are determined by the desired water quality and the characteristics of the packed column.

If the water contains a high amount of silica scale elements, the silica scale elements can be removed by bringing the water into contact with an $HCO_3^-$ type anion exchange resin and a hydroxide ion type strongly basic anion exchange resin. Depending on the concentration of silica scale elements, the cooling water may be treated in any of a number of ways. For example, the entire volume of cooling water may be brought into contact with the $HCO_3^-$-type anion exchange resin, and then passed through the hydroxide ion type strongly basic anion exchange resin. Alternately, a portion of the water from the water system may be brought into contact with a bicarbonate ion type anion exchange resin, and the remainder brought in contact with the strong base hydroxide anion exchange resin. In the latter case, the ratio of the amounts of water brought into contact with each anion exchange resin is controlled so that the concentration of the silica in the water system remains lower than the concentration at which silica scales are formed. However, it is desirable to retain a certain amount of silica in the treated water, because silica is a corrosion inhibiting ion. In order to maintain an appropriate amount of silica in the treated water, the latter method is preferable, because the hydroxide ion type strongly basic anion exchange resin will remove silica completely (see Japanese Laid-open Patent Publication No. 7-334883).

As an alternative method for bringing water into contact with the anion exchanger, the raw water may be adjusted to have a pH less than 5. After the pH is adjusted, the water passes through a $CO_3^{2-}$ type anion exchanger. The corrosive anions in the water are then changed to the corrosion-inhibiting $HCO_3^-$. (See Japanese Laid-Open Patent Publication No. 6-118292). The pH of the raw water may be brought to a value below 5 by any appropriate means, such as bubbling carbon dioxide gas into the raw water, or bringing the raw water into contact with a H-type strongly acidic cation exchange resin. The latter method removes not only all of the cationic elements of the raw water, but also methyl orange alkalinity elements, due to the decrease in pH. Therefore, this latter method is preferable. If this latter method is employed, the pH before the anion exchanger is preferably in the range between 2 and 4. The $CO_3^{2-}$ in the anion exchanger is thus changed to corrosion inhibiting $HCO_3^-$ (see Japanese Laid-Open Patent Publication No. 6-118292).

In the present invention, besides $HCO_3^-$, additional corrosion-inhibiting ions may also be present in appreciable amounts. For example, $SiO_2$ in water alters the rust of mild steel so that it has a sticking tendency, thereby further improving the corrosion inhibiting action. In addition, corrosion-inhibiting ions $Ca^{2+}$ and $HCO_3^-$ combine to form an uniform precipitate film of $CaCO_3$ on metal surfaces. This film prevents the diffusion of dissolved oxygen, which is necessary to promote corrosion.

The low molecular weight polymer added to the fresh water system is preferably a water soluble polymer of molecular weight between 500 to 100,000, and more preferably between 1,000 and 20,000. The amount of low molecular weight polymer to be added will vary according to the desired water quality of the water system. Preferably, 0.1–500 mg of low molecular weight polymer/L of water is added.

The low molecular weight polymer may be added at any time. Preferably, the polymer is added after treatment with the above anion exchanger. The low molecular weight polymer may be, for example, a maleic acid-isobutylene polymer, a polyacrylic polymer, a partially hydrolyzed polyacrylamide, an acrylic-allyloxy-2-hydroxypropane sulfonic acid polymer, an acrylic-hydroxyethyl methacrylic polymer, an acrylamide-allyl sulphonic acid polymer, an acrylic-maleic acid polymer, an acrylic-styrene polymer, an acrylic-styrene sulfonic acid polymer, a polymaleic acid polymer, a polystyrene sulfonic acid polymer, an acrylic-itaconic acid polymer, a polyitaconic acid polymer, an acrylic-acrylonitryl polymer, an acrylic-vinyl sulfonic acid polymer, or a methyl vinyl ether-maleic acid polymer.

Generally, in various water systems, the ratio of dissolved solids concentration in the circulating water to that of the makeup water is defined as the cycles of concentration. The value for the cycles of concentration is adjusted by the operation requirements. The cycles of concentration are defined as $$N = \frac{\text{dissolved solids concentration in circulating water}}{\text{dissolved solids concentration in makeup water}}$$

In the method of the present invention, the number of cycles is raised to and maintained at N=3–7 by controlling the operational conditions of the system. Then, immediately after reaching the target cycles of concentration of N=3–7, the chlorine containing slime controlling agent is added. This prevents slime formation.

The chlorine containing slime-controlling agent may be a $Cl^-$ ion-containing compound, such as chlorine, sodium hypochlorite, calcium hypochlorite, or chlorinated isocyanurate. In order to maintain the optimal $Cl^-$ concentration in the water, the amount of chlorine-containing oxidative slime controlling agent added should be between 1–3 mg $Cl_2$/L of circulating water, and preferably between 0.1–1 mg $Cl_2$/L of circulating water. In order to utilize a chlorine-containing slime controlling agent effectively with this corrosion inhibition method, the upper limit of the chloride ion concentration must be determined. At too high a $Cl^-$ concentration, the $Cl^-$ will begin to cause corrosion of the metal components. By maintaining the chloride ion concentration below 50 mg/L, and preferably below 30 mg/L, in the water system, chlorine-containing slime controlling agents will not diminish the effectiveness of the anion exchange corrosion inhibition method.

In the present invention, the water is preferably analyzed when the slime-controlling agent is added. The amount of blow water is adjusted so that the $Cl^-$ concentration remains below 50 mg/L, and preferably below 30 mg/L. The cooling water may also be passed through an anion exchange resin to further decrease the $Cl^-$ concentration. Therefore, when using an anion exchange method in conjunction with slime control by a chlorine-containing slime-controlling agent, a satisfactory corrosion-inhibiting effect can be maintained, as long as the $Cl^-$ concentration is below 50 mg/L, and preferably below 30 mg/L. The present invention has the advantage of preventing corrosion without generating significant environmental problems.

Besides chlorine-containing slime controlling agents, non-chlorine containing slime controlling agents, such as benzoisothiazoline-3-on or 2-bromo-2-nitropropane-1,3-diole, or the like may be used in combination. Corrosion-inhibiting agents may also be added as needed, including inorganic phosphate (orthophosphate or polyphosphate), organic phosphoric ester, phosphonic acids, zinc salts, nickel salts, tungstate, molybdate, nitrite, borate, silicate, hydroxycarboxylate, benzotriazole, mercaptobenzothiazole, and the like. Lignin derivatives, tannic acid, polysaccharides (such as starch) and the like may also be included to inhibit scaling.

Experiment 1

Industrial water was treated by anion exchange, and then concentrated. A polymaleic acid type low molecular weight polymer (Belcren 200, manufactured by FMC) was added to one liter of the concentrated test water, which had a water quality as indicated below. Sodium chloride was then added until the $Cl^-$ concentrations reached each of the concentrations shown in FIG. 1.

Water quality of test water of Experiment 1:

| | |
|---|---|
| pH: | 9.0 |
| Calcium hardness: | 90 mg $CaCO_3$/L |
| Methyl orange alkalinity: | 400 mg $CaCO_3$/L |
| Silica: | 100 mg $SiO_2$/L |
| $Cl^- + SO_4^{2-}$: | <1 mg/L |
| low molecular weight polymer: | 20 mg (solid weight)/L |

A mild steel test coupon (SPCC; surface area 31.4 $cm^2$) was attached to a rotating shaft and immersed in each of the test waters. The steel test coupons were then rotated at 180 rpm in the test waters. The experiment was conducted at water temperatures of 30° C. and 50° C., for 7 days each. After the experiment, the reduction in the weights of the test coupons were measured, and the corrosion rates were calculated. The results are shown in FIG. 1. The corrosion rates are given in units of mdd (mg test coupon lost/$dm^2$/day).

Referring to FIG. 1, it is clear that corrosion is prevented if the $Cl^-$ concentration is below 50 mg/L, and preferably below 30 mg/L, and even more preferably below 20 mg/L.

Embodiment 1

An acrylic column of length 1000 mm and inner radius 38 mm was filled with one liter of a strongly basic anion exchange resin (Diaion SA20A, manufactured by Mitsubishi Chemical Corporation). The anion exchange resin was regenerated with a 5% $NaHCO_3$ solution, creating an $HCO_3^-$ type anion exchange resin. The resin was then washed with water. Atsugi city water was passed through this $HCO_3^-$ type anion exchange column and anions were exchanged. The treated water had a water quality as indicated below.

Water quality of treated water:

| | |
|---|---|
| pH: | 7.8 |
| Calcium hardness: | 40 mg $CaCO_3$/L |
| Methyl orange alkalinity: | 80 mg $CaCO_3$/L |
| Silica: | 25 mg $SiO_2$/L |
| $Cl^- + SO_4^{2-}$: | <1 mg/L |

20 mg (solid weight)/L of the same low molecular weight polymer as used in experiment 1 was added to the treated water. A model heat exchanger test device which simulated a real system was employed. The test system had the characteristics shown below.

Characteristics of the test system:

| | |
|---|---|
| Holding water quantity: | 300 L |
| Flow velocity: | 0.5 m/S |
| Water temperature at heat exchanger inlet: | 30° C. |
| Water temperature at heat exchanger outlet: | 50° C. (steam heated) |
| Water temperature difference (Δt): | 20° C. |

Figure 2:
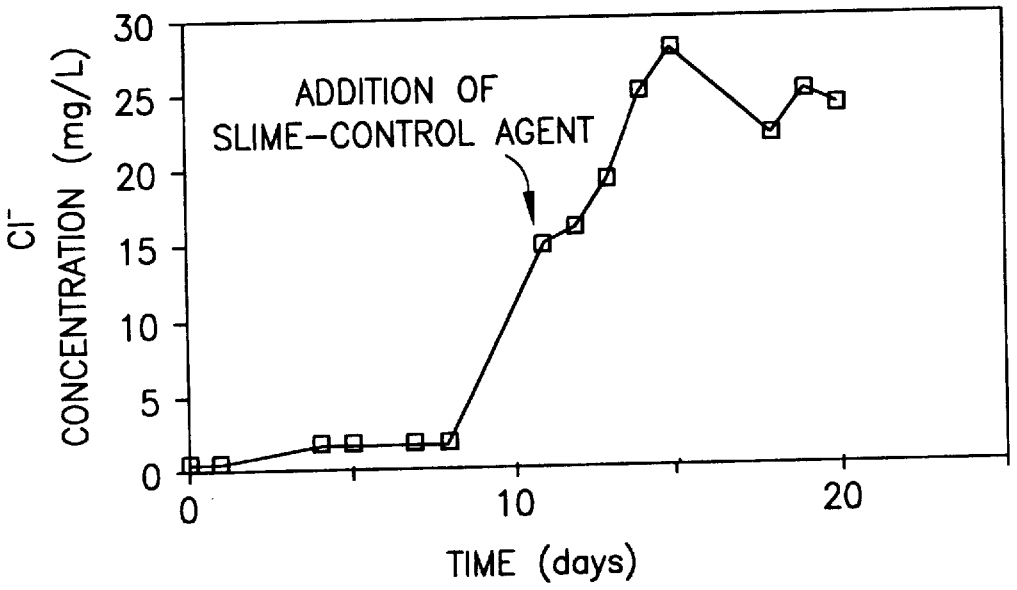
FIG. 2 is a graph showing the changes in $Cl^-$ concentration over time in the experiment of Embodiment 1.

The treated water was passed through a carbon steel tube (STB-340: 19 mm radius×2.2 mm thickness×2900 mm length) for 20 days, and the amount of corrosion was measured. Immediately after the dissolved solids concentration reached the desired value, the chlorine containing slime controlling agent (sodium hypochlorite) was added in the range of 0.5–1 mg $Cl_2$/L, so as not to exceed a $Cl^-$ concentration of 30 mg/L in the water system. The target value of the dissolved solids concentration was N=5, when operating at a Δt=20° C. FIG. 2 shows the concentration of $Cl^-$ ion over the course of the experiment.

The results after the 20 day flow test showed that the corrosion rate was 1.2 mg/$dm^2$/day. The deepest pitting corrosion was 0.05 mm/month. Slime adhesion was adequately suppressed by the addition of a chlorine containing slime controlling agent. The results of this embodiment showed that when using chlorine-containing slime controlling agents, corrosion inhibition was maintained at a satisfactory level by maintaining a $Cl^-$ concentration of ≦30 mg/L.

As described above, the corrosion inhibition method of the present invention reduces corrosive ions in a fresh water system by anion exchange. Addition of a low molecular weight polymer accelerates the formation of a film on metal surfaces. The low molecular weight polymer utilizes the corrosion-inhibiting anions dissolved through ion exchange and the corrosion-inhibiting ions in the water system to form an uniform corrosion-inhibiting film on the surface of the metal components. Corrosion of metal components of a fresh water system can be inhibited without negative environmental effects. By maintaining the chloride ion concentration below a predetermined level, chlorine-containing slime controlling agents may also be used. This allows inhibition of slime growth without loss of the above corrosion inhibiting effects.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A metal corrosion inhibiting method for a water system, comprising the steps of:

passing a portion of water through a first anion exchanger;

said first anion exchanger containing $HCO_3^-$ anions;

passing the remainder of said water through a second anion exchanger;

said second anion exchanger containing hydroxide ions;

adding a low molecular weight polymer to said water;

adding a chlorine-containing slime controlling agent so as not to exceed a chloride ion concentration of 50 mg/L in said water system.

2. A metal corrosion inhibiting method for a water system according to claim 1, wherein:

said low molecular weight polymer is a water soluble polymer of molecular weight between 500 and 100,000; and said low molecular weight polymer is at least one member of the group consisting of a maleic acid-isobutylene polymer, a polyacrylic polymer, a partially hydrolyzed polyacrylamide, an acrylic-allyloxy-2-hydroxypropane sulfonic acid polymer, an acrylic-hydroxyethyl methacrylic polymer, an acrylamide-allyl sulphonic acid polymer, an acrylic-maleic acid polymer, an acrylic-styrene polymer, an acrylic-styrene sulfonic acid polymer, a polymaleic acid, a polystyrene sulfonic acid polymer, an acrylic-itaconic acid polymer, a polyitaconic acid polymer, an acrylic-acrylonitryl polymer, an acrylic-vinyl sulfonic acid polymer, and a methyl vinyl ether-maleic acid polymer.

3. A metal corrosion inhibiting method for a water system according to claim 2, wherein said low molecular weight polymer is a water soluble polymer of molecular weight between 1,000 and 20,000.

4. A metal corrosion inhibiting method for a water system according to claim 2, wherein said low molecular weight polymer is maintained at a concentration between 0.1 and 500 mg/L.

5. A metal corrosion inhibiting method for a water system according to claim 1, further including the step of:

determining a value of N, wherein N is defined as $$N = \frac{\text{concentration of dissolved solids in circulating water}}{\text{concentration of dissolved solids in makeup water}};$$

maintaining N at a value between 3 and 7.

6. A metal corrosion inhibiting method for a water system according to claim 5, wherein said step of adding said slime controlling agent is substantially immediately subsequent to said step of maintaining N at a value between 3 and 7.

7. A metal corrosion inhibiting method for a water system according to claim 1, wherein said slime controlling agent further includes at least one of the group consisting of 5-chloro-2-methyl-4-isothiazone-3-on, benzoisothiazolene-3-on, and 2-bromo-2-nitropropane-1,3-diol.

8. A metal corrosion inhibiting method for a water system according to claim 1, wherein said slime controlling agent is added to a concentration between 0.1–3 mg as $Cl_2$/L of circulating water.

9. A metal corrosion inhibiting method for a water system according to claim 1, wherein said slime controlling agent is added to a concentration between 0.1–1 mg as $Cl_2$/L of circulating water.

10. A metal corrosion inhibiting method for a water system, comprising the steps of:

passing a portion of water through a first anion exchanger;

said anion exchanger containing corrosion-inhibiting anions;

passing the remainder of said water through a second anion exchanger; said second anion exchanger containing corrosion-inhibiting anions different from said corrosion-inhibiting anions in said first anion exchanger;

adding a low molecular weight polymer to said water; and adding a chlorine-containing non-oxidative slime controlling agent so as not to exceed a chloride ion concentration of 50 mg/L in said water system.

11. A metal corrosion inhibiting method for a water system according to claim 10, wherein said chlorine-containing non-oxidative slime controlling agent is at least one of 5-chloro-2-methyl-4-isothiazolin-3-on and 4,5-dichloro-1,2-dithiol.

12. A metal corrosion inhibiting method for a water system according to claim 10, further comprising adding a non-chlorine-containing slime controlling agent.

13. A metal corrosion inhibiting method for a water system according to claim 12, wherein said non-chlorine-containing slime controlling agent is at least one of benzothiazoline-3-on and 2-bromo-2-nitropropane-1,3-diol.

14. A metal corrosion inhibiting method for a water system, consisting of the steps of:

passing a portion of water through a first anion exchanger;

said anion exchanger containing corrosion-inhibiting anions;

passing the remainder of said water through a second anion exchanger; said second anion exchanger containing corrosion-inhibiting anions different from said corrosion-inhibiting anions in said first anion exchanger;

adding a low molecular weight polymer to said water after said step of passing; and adding a chlorine-containing non-oxidative slime controlling agent after said step of adding a low molecular weight polymer so as not to exceed a chloride ion concentration of 50 mg/L in said water system.

15. A metal corrosion inhibiting method for a water system according to claim 14, wherein said chlorine-containing non-oxidative slime controlling agent is at least one of 5-chloro-2-methyl-4-isothiazolin-3-on and 4,5-dichloro-1,2-dithiol.

16. A metal corrosion inhibiting method for a water system according to claim 14, further comprising adding a non-chlorine-containing slime controlling agent.

17. A metal corrosion inhibiting method for a water system according to claim 14, wherein said non-chlorine-containing slime controlling agent is at least one of benzothiazoline-3-on and 2-bromo-2-nitropropane-1,3-diol.

* * * * *